US005474221A

United States Patent [19]

Klinga

[11] Patent Number: 5,474,221

[45] Date of Patent: Dec. 12, 1995

[54] ROTARY STAPLING MACHINE

[75] Inventor: Bengt Klinga, Tyresö , Sweden

[73] Assignee: Tolerans Ingol Sweden AB, Tyresö , Sweden

[21] Appl. No.: 196,488

[22] Filed: Feb. 15, 1994

[30] Foreign Application Priority Data

Feb. 18, 1993 [SE] Sweden ..... 93005361

[51] Int. Cl.[6] ..... B27F 7/23

[52] U.S. Cl. ..... 227/81; 227/82; 227/155; 270/53

[58] Field of Search ..... 227/81, 82, 155; 270/37, 53

[56] References Cited

U.S. PATENT DOCUMENTS

| | | | |
|---|---|---|---|
| 2,987,729 | 6/1961 | Taynton | 227/155 X |
| 4,194,666 | 3/1980 | Spehrley, Jr. et al. | 227/155 |
| 4,204,626 | 5/1980 | Kutzner et al. | 227/81 |
| 4,204,627 | 5/1980 | Kutzner et al. | 227/81 |
| 4,449,661 | 5/1984 | Spehrley, Jr. | 227/155 |

FOREIGN PATENT DOCUMENTS

| | | |
|---|---|---|
| 0399317 | 11/1990 | European Pat. Off. . |
| 747959 | 10/1944 | Germany . |

*Primary Examiner*—Rinaldi I. Rada
*Assistant Examiner*—Jay A. Stelacone
*Attorney, Agent, or Firm*—Burns, Doane, Swecker & Mathis

[57] ABSTRACT

A rotary stapling machine includes a first rotatable roller, a staple retainer mounted on the first roller to retain a U-shaped staple in a predetermined orientation, and a second rotatable roller having a die. The first and second rollers are adjacently positioned and spaced to allow material for stapling to pass between. Rotation of the first and second rollers positions the staple retainer and the die in a coacting position wherein the staple legs are bent toward the staple retainer. The die includes a pair of bending plates pivotally mounted in a slot that communicates with an outer surface of the second roller. The bending plates have forming surfaces that contact the legs of the staple and by pivoting toward the first roller, drive the legs toward the staple retainer and hold the legs in a desired bent position.

10 Claims, 3 Drawing Sheets

ROTARY STAPLING MACHINE

TECHNICAL FIELD

The present invention relates generally to a so-called rotary stapling machine, and more particularly to a rotary stapling machine of the kind which includes a first rotatable cylinder, a so-called stapling cylinder, which coacts with means to maintain a U-shaped staple in a predetermined position of orientation, said means being referred to as a stapling fork, a second rotatable cylinder, a so-called counterpressure cylinder which coacts with a die, wherein said die and said means are mutually so related to the cylindrical surfaces of respective cylinders that as they rotate, they can be given a mutually facing and/or mutually coacting position adapted so as to enable the die to bend the legs of the U-shaped staple in a direction towards said means, and wherein the rotatable cylinders are mutually adapted to allow material to be stapled to pass therebetween material.

BACKGROUND ART

A rotary stapling machine of the aforesaid kind is known to the art and is constructed to apply staples to a material at predetermined distances apart along a material web with the aid of a stapling cylinder, a counterpressure cylinder, a forming drum, a horn which extends around the peripheral surface of the stapling cylinder between the forming drum and the counterpressure cylinder, and a stapling fork which, in coaction with the stapling cylinder, functions to cut staple forming wire-like material in the region between the stapling cylinder and the forming drum and to form a U-shaped staple, which is carried by the stapling fork and the stapling cylinder to the region between the stapling cylinder and the counterpressure cylinder and there fastened to a continuous web of material passing between the stapling cylinder and the counterpressure cylinder, with the aid of a die or anvil mounted on the counterpressure cylinder. A rotary stapling machine of the aforesaid kind is used to staple together multi-page newspapers, magazines or the like along the spine-parts thereof, and forms one processing station, among several, for processing printed matter exiting from a printing machine.

The printed paper material is folded in different ways to produce a newspaper, magazine or the like, and the individual pages and sheets are joined together by means of spine-related staples.

Rotary stapling machines of the aforesaid kind have earlier comprised a die which is fixedly mounted to the counterpressure cylinder and which includes two mutually adjacent grooves having a form which guides the legs of the U-shaped staple along curved grooves in the die as the legs are curved, wherein the free ends of the legs are curved back towards the intermediate part of the staple which joins said lets together, so as to clamp the legs against the material or paper sheets, preferably between the ends of the legs and the centre region of said leg connecting part.

A rotary stapling machine of the aforedescribed construction is known from a machine retailed by Tolerans Ingol Sweden AB, Tyresö, Sweden, under the designation "Tolerans" or "Ingol" adapted for newspapers.

In the following, a staple which when compressed exhibits the curved shape that a fixed die of the aforesaid kind imparts to the staple will be referred to as a "roller staple".

However, other devices adapted for other applications and which, in many respects, provide better securement of the material with staples where the staple legs are brought to a flattened state as the staple is compressed and are orientated in a more or less parallel relationship with the leg-joining part by being bent within a limited region also belong to the known prior art.

This type of staple will be referred to in the following as a "flat staple".

TECHNICAL PROBLEMS

When considering rotary stapling machines of the aforedescribed kind, it will be seen that a technical problem resides in the general construction of such machines and more specifically in the creation in such machines of conditions which, with retained speed or frequency, will enable the legs of a U-bent staple to be compressed and bent inwards to a form and a stapling state which conforms to the form of a "flat staple".

It will also be seen that a technical problem resides in realizing the need of fitting the counterpressure cylinder of a rotary stapling machine with a die unit which includes a movable anvil means which functions to bend the staple legs in an initial stage of a stapling process and which then functions as a counterpressure surface and leg pressing means in a final stage of said process.

It will also be seen that a technical problem is one of providing with the aid of relatively simple means conditions such that under relatively short time intervals, two mutually opposing and pivotally related anvils will serve as leg-bending means and thereafter as counterpressure means, subsequent to the staple legs having penetrated the material web in the region between the counterpressure cylinder and the stapling cylinder.

It will also be seen that a technical problem resides in realizing the significance of orienting the die unit in or immediately adjacent the cylindrical surface of a second cylinder, a counterpressure cylinder, and of including movable leg-bending means or anvils which coact with respective legs.

It will also be seen that a technical problem resides in the provision of conditions which enable leg-bending means to move towards the first rotatable cylinder or stapling cylinder for bending said legs around a limited region.

With a starting point from the present standpoint of techniques with regard to rotary stapling machines, another technical problem resides in realizing the significance of providing the die unit with a penetrating slot into which the legs of a U-shaped staple can be inserted and to arrange in said slot two mutually opposed thin plates which are each pivotal about a pivot axle and which function as leg bending and counterpressure abutments.

Another technical problem is one of realizing the significance of providing each plate with a respective flat actuator surface which is able to rotate through an angle of from 45° or smaller from a leg-bending initiating position to a leg-bending terminating position, in which the surface functions almost completely as a counterpressure or anvil surface.

It will also be seen that a technical problem resides in the significance of ensuring that in the leg-bending terminating position, respective legs are positioned essentially parallel with the intermediate staple part that joins said legs together, and preferably a position in which the free ends of the legs are bent slightly closer to said leg-joining part than the curved parts of the legs.

Another technical problem is one of realizing the significance of causing the leg-bending means to begin bending the legs before the leg-joining part of the staple takes its closest position to the die.

It will also be seen that a technical problem resides in realizing the significance of allowing the leg-bending means to be actuated by a camming-curve actuable rod or punch towards a position in which the legs are bent completely straight.

Still another technical problem is one of realizing the significance of enabling the punch to move reciprocatingly in a radial direction of said roller or counterpressure cylinder.

Yet another technical problem is one of realizing the significance of providing and dimensioning a spring device which is capable of moving or rotating respective leg-bending means rapidly to a position in which bending of the legs is commenced.

SUMMARY OF THE INVENTION

An object of the present invention is to solve one or more of the aforesaid technical problems with the aid of a rotary stapling machine which is comprised of a first rotatable roller which coacts with means for holding a U-bent staple in a predetermined position among other things, a second rotatable roller and a die which coacts with said second roller, wherein the die and said holding means are mutually so related to the cylindrical surfaces of respective rollers as to enable them, upon rotation, to be brought to a mutually coacting position adapted to bend the legs of the U-shaped staples in a direction towards said means, wherein the rotatable rollers are mutually so adapted as to enable material to be stapled, such as a paper web or a number of paper sheets, to pass therebetween.

In accordance with the present invention, it is proposed that the die of such a rotary stapling machine will comprise a die unit and will be positioned in or in the close proximity of a cylindrical surface on said second roller and will include leg-bending means which are movably arranged beneath said cylindrical surface and which coact with the legs of the staple and which are arranged to pivot towards said first rotatable roller to bend said legs and then within a region belonging to a cylindrical surface of said first roller located adjacent said means or within a region defined by said means so as to hold a staple.

According to preferred embodiments which lie within the scope of the present invention, the die is provided with a narrow slot into which the free ends of the legs of a staple can be guided and which also accommodates two oppositely directed plates which function as leg-bending means and as anvil or counterpressure means and each of which is pivotable about a respective pivot axle.

Each of the plates will preferably include a flat actuating surface which can rotate within an angular range defined by an angle smaller than 45°, from a position in which bending of the legs is commenced to a position in which bending of said legs is terminated.

It is also proposed that when in the position in which bending of the legs is terminated, respective legs will extend generally parallel to that part of the staple which joins the legs together.

It is also proposed that the leg-bending means is constructed to commence bending of the legs before the leg-joining part of the staple is in its closest position to the die.

The leg-bending means can be actuated to a position in which the legs are completely bent inwards, by means of a rod or punch actuated by a camming curve.

The punch is mounted for reciprocal movement in a radial direction of said roller.

Finally, the machine will include a spring device which functions to move or rotate respective leg-bending means to a position in which bending of the legs is commenced.

ADVANTAGES

Those advantages that are primarily afforded by the inventive rotary stapling machine reside in the creation of conditions whereby the staples used are bent flat to conform with the surface of the paper web while effectively securing the paper.

The main characteristic features of an inventive rotary stapling machine are set forth in the characterizing clause of the following Claim 1.

BRIEF DESCRIPTION OF THE DRAWINGS

An exemplifying embodiment of a rotary stapling machine at present preferred and possessing characteristic features significant of the present invention will now be described in more detail with reference to the accompanying drawings, in which.

DESCRIPTION OF EMBODIMENTS AT PRESENT PREFERRED

Figure 1:
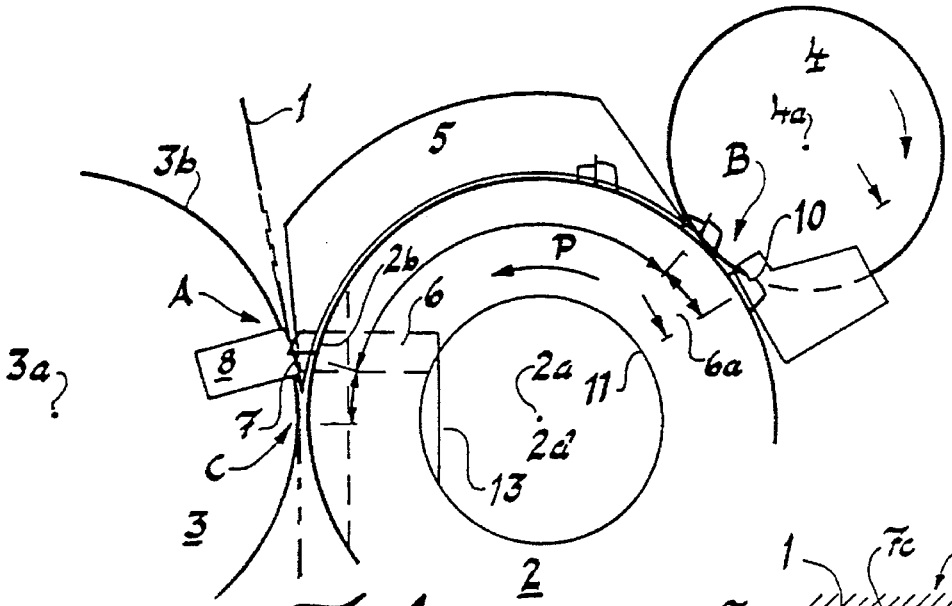
FIG. 1 is a greatly simplified illustration showing in side view a rotary stapling machine which is known in principle and which includes a stapling cylinder, a counterpressure cylinder and a forming drum.

FIG. 1 is a greatly simplified side-view illustration of a rotary stapling machine which is comprised of a first rotatable roller 2, or a so-called stapling cylinder, which coacts with means 6 in the form of a stapling fork to retain a U-bent staple 7 in a predetermined position of orientation, a second rotatable roller 3 in the form of a counterpressure cylinder which coacts with a die 8, wherein the die 8 and the means 6 are mutually so related to the cylindrical surfaces of respective rollers as to enable them, upon rotation, to be brought to a mutually coacting position in which the legs of the U-shaped staple can be bent in a direction towards said means 6, wherein the rotatable rollers are mutually so adapted as to enable material 1 to be stapled to pass therebetween, said material 1 normally having the form of a paper web which enters the stapling machine and exits therefrom at a selected angle of about 5°.

As illustrated in FIG. 1, the rotary stapling machine requires for its function a stapling cylinder 2 which is mounted on a centre axle 2*a* for rotation in the direction of the arrow "P", a counterpressure cylinder 3 which is mounted for rotation about a centre axle 3*a*, and a forming drum 4 which is mounted for rotation about a centre axle 4*a*.

The stapling machine also includes a disc-like horn 5 which extends around the upper peripheral surface of the stapling cylinder 2 between the forming drum 4 and the counterpressure cylinder 3 and the width of which is adapted to the free distance between two legs of a U-shaped staple which coacts with a stapling fork 6 fixedly mounted on the stapling cylinder 2 and accompanies rotation of said stapling cylinder. The stapling fork 6 is intended to press the two legs 7*a* and 7*b* of a staple 7 through the paper web 1 and in a direction towards an anvil or die 8 fixedly mounted in the counterpressure cylinder 3, in the region "A" shown in FIG. 1.

However, the stapling fork 6 can take a position 6*a* located in the region B between the stapling cylinder 2 and the forming drum 4, and is there adapted to cut a staple-forming wire-like material 10 and, at the same time, form a U-shaped staple which is carried by the stapling cylinder to the region "A" between the stapling cylinder and the counterpressure cylinder, so as to be fastened to a material web 1 passing between the stapling cylinder and the counterpressure cylinder. The stapling fork 6 is intended to move along a path 11, at least in the region B between the stapling cylinder and the forming drum, so as to therewith cut and shape a staple 7.

The stapling fork 6 runs along a path or track 13 in the region A and C.

Figure 2:
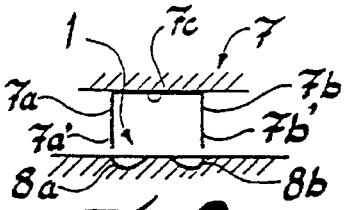
FIG. 2 is a sectioned side view of a U-shaped staple prior to its legs being pressed against a fixed die which includes curve-forming grooves.

Shown in FIG. 2 is a U-shaped staple 7 having perpendicularly oriented legs 7*a* and 7*b* located on a respective side of a leg-joining part 7*c*. Bending of the legs 7*a* and 7*b* is effected while guiding the legs in grooves not shown. A punch which is able to coact with the stapling fork 6 presses the staple 7 through the material 1 (not shown), so that the free ends 7*a'* and 7*b'* of the legs will be pushed down against the die 8. Further downward movement of the legs causes the tips thereof to be curved by and along grooves 8*a* and 8*b*, the legs being bent continuously so that the tips 7*a'* and 7*b'* thereof will face towards the leg-joining part 7*c*, in the manner illustrated in FIG. 3.

Figure 3:
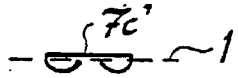
FIG. 3 illustrates the staple shown in FIG. 2 subsequent to the legs having been pressed by a punch against a die and curved to an arcuate shape thereby to form a "roller staple"

A multi-sheet paper web 1 clamped by a staple will now be held together mainly by the pressure of the tips 7*a'* and 7*b'* against the leg-joining part 7*c* within its centre region 7*c'*, as shown in FIG. 3.

Figure 4:
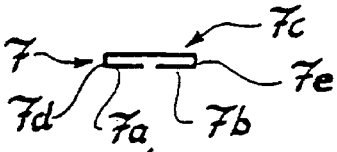
FIG. 4 is a side view of a U-shaped staple in which the two legs have been bent to form a "flat staple"

However, there are other ways in which the legs 7*a*, 7*b* can be pressed together to form a "flat staple". This is illustrated by FIG. 4, in which the legs 7*a* and 7*b* of a U-shaped staple 7 are orientated parallel with the leg-joining part 7*c* of the staple, wherewith the material lying therebetween (not shown) is clamped primarily within the region 7*d* and 7*e* at the same time as the legs 7*a* and 7*b* assist in pressing said material against the leg-joining part 7*c*.

The present invention is intended to provide a rotary stapling machine in which a "flat staple" can be produced while retaining the high stapling rate of such a machine.

According to the invention, there is required to this end a specially constructed die unit 8' instead of a fixed die or anvil 8.

This die unit 8' is comprised of a mechanical unit that can be fitted in a recess in the peripheral surface of the counterpressure roll 3 such that the outer surface 8" of the die unit 8' will lie in a plane with the peripheral surface 3*b* of the counterpressure roller or cylinder 3.

The die unit 8' may be located in or in the immediate vicinity of a cylindrical surface 3*b* of the second roller or cylinder 3 and includes leg-bending means arranged for movement beneath said cylindrical surface and capable of coacting clampingly with respective legs, wherein said means are intended to rotate towards said first rotatable roller 2 for the purpose of bending said legs, and then within a region 2*b* of a cylindrical surface of said first roller located adjacent said means for holding a staple, or within a region defined by said staple holding means.

Figure 5:
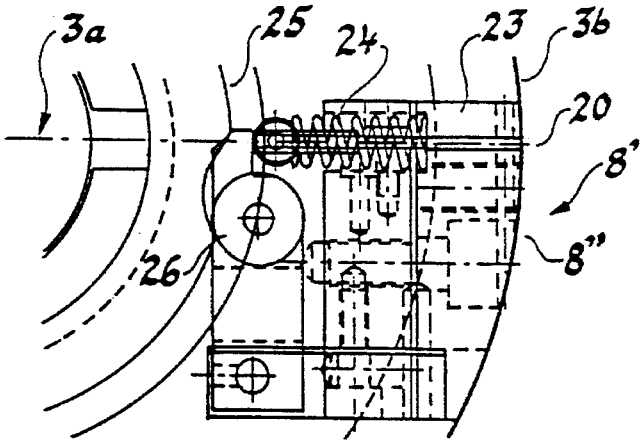
FIG. 5 is a side view, partly in section, of an inventive die unit which can be readily fitted to the counterpressure cylinder.

As shown in FIG. 5, the die unit 8' is provided with a narrow slot 20 whose width slightly exceeds the thickness of the staple legs, so that the legs can be guided into the die unit 8'.

The slot accommodates two mutually identical plates 22 (only one of which is shown in FIGS. 6–11) which are directed towards one another and each of which is rotatable about a respective axle 21, said plates 22 functioning as leg-bending means and also has anvil means.

Each plate 22 has a 22*a* surface which initially has a leg-bending function and finally an essentially anvil function.

Figure 6:
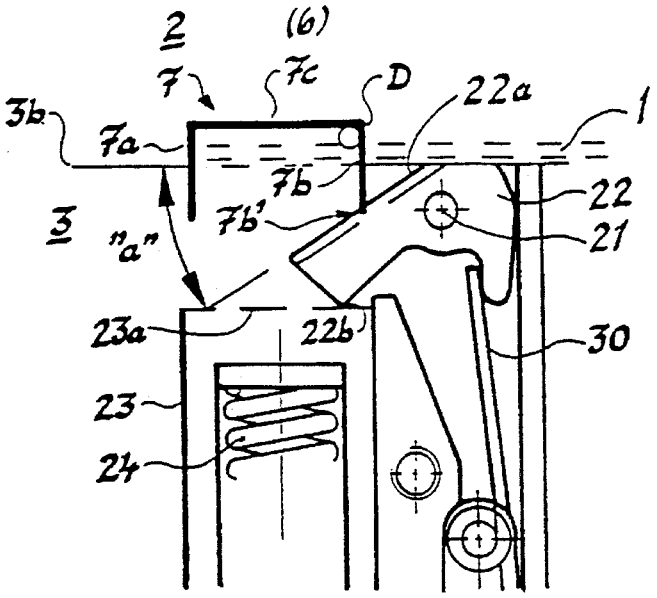
FIGS. 6–11 show the sequence of movement of the leg-bending means in response to different setting positions of the counterpressure cylinder and the stapling cylinder within the region of the stapling function.
Figure 7:
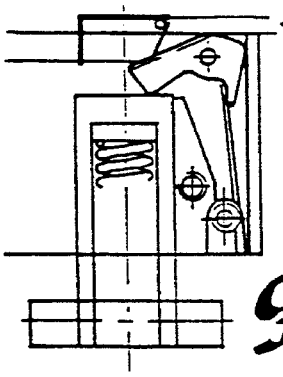
Figure 8:
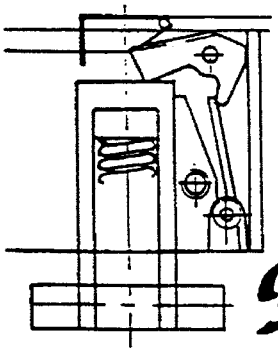

FIG. 6 is drawn to a slightly larger scale than FIGS. 7–11 and is intended to illustrate the setting of the plate 22 5° before the "point of contact C" between the rollers 2 and 3. FIG. 7 is intended to show the position of the plate 22 at 2.5° and FIG. 8 is intended to illustrate the position of the plate at 0°. (The contact point C).

Figure 9:
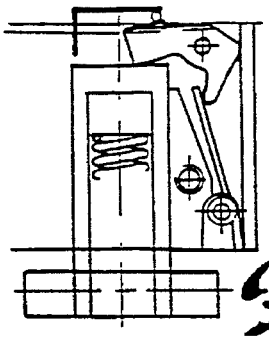
Figure 10:
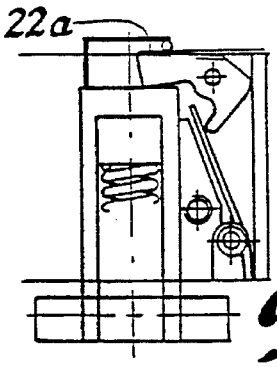
Figure 11:
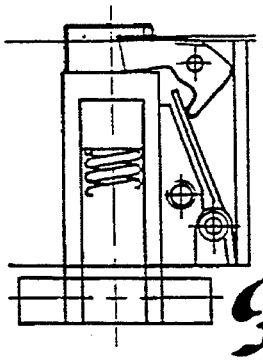

FIG. 9 shows the position of the plate at –2.5°, FIG. 10 at –5° and FIG. 11 at –7.5°, which implies that the contact point "C" has been passed.

It will be seen from these Figures that the plate 22 rotates gradually around its rotary axle 21 so as to initially bend the leg 7*b* progressively towards a leg-joining part 7*c* and therewith gradually form a flat staple.

It is important to establish that the surface 22*a* in the position shown in FIG. 10 will adopt a purely horizontal position, such that the leg 7*b* is positioned parallel to the part 7*c*, and that the surface 22*a* will rotate further up towards said part 7*c* in FIG. 11 so as to compensate for any spring-back.

The plate 22 has an actuator surface 22*a* which is intended to rotate within angular range defined by a maximum angle of 45°. FIG. 6 shows the angle "a", which is about 30° in this case.

In the bending terminating position, respective legs 7*b* are positioned essentially parallel with the leg-joining part 7*c*, as illustrated in FIGS. 10 and 11.

It will also be seen from FIG. 6 that the leg-bending means is adapted to commence bending of the legs prior to the leg-joining part 7*c* being brought to its closest position to the die unit 8', which is illustrated by a comparison between the positions shown in FIGS. 7 and 8.

The leg-bending means 22 are actuable towards a position in which the legs are fully bent inwards by a rod 23 which is actuated by a camming plate 25 (shown in FIG. 1), said rod having an upper slide surface 23*a* which is intended to coact with a slide surface 22*b* on a respective plate 22. The rod 23 includes a spring device 24.

Referring back to FIG. 5, it will be seen that the rod 23 is reciprocatingly movable in the radial direction of the roller 3, and a wheel 26 can be forced down with the aid of a spring 24 and a camming plate 25 and in this way raise the rod 23 in accordance with the pattern shown in FIGS. 6 to 11.

The position shown in FIG. 5 is commensurate with the position shown in FIG. 11. The angular value "a" is significant and depends on the friction that occurs between the tip 7*b'* of the leg 7*b* and the surface 22*a*, since there is required in this connection a coordination such that during the bending process the leg 7*b* will be straight, i.e. the actual material flow during the bending process shall take place exclusively in the region "D" in order to securely clamp the material 1.

A further spring device 30 is provided for holding the plate 22 in the position shown in FIG. 6 and is intended to restore the plate 22 by spring force to this position from the position shown in FIG. 11 as the rod 23 moves downwards.

Figure 12:
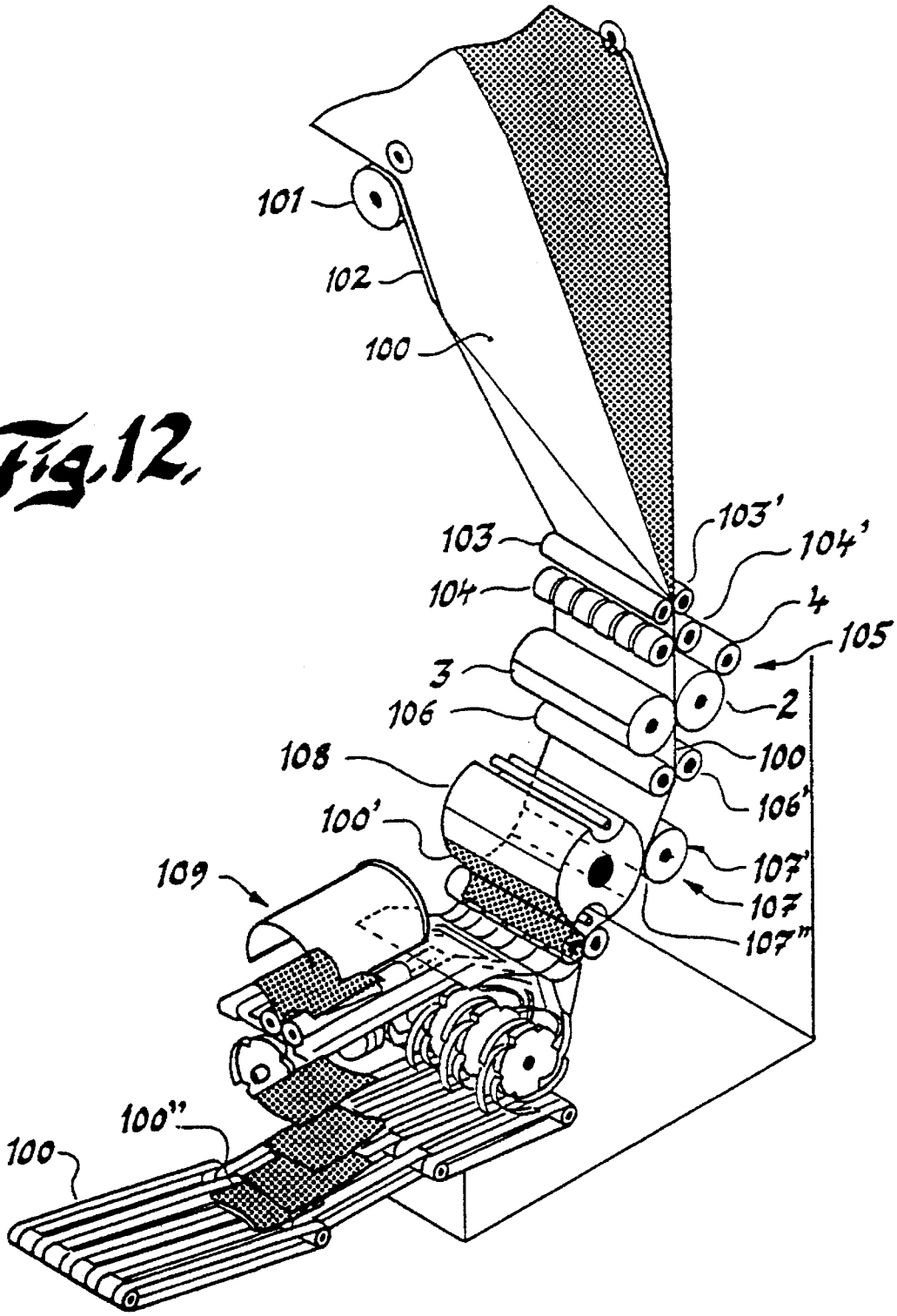
FIG. 12 show the machine on-line in a printing press.

In order to exemplifying the practical use of a machine of the inventive embodiment on-line in a printing press FIG. 12 discloses a previously known printing press with paper folding means arranged upstreams the machine and donstreams the machine.

In is here disclosed the a printed continuous paper web or path is running over a roller 101 and designated the referens numeral 100. The web 101 is folded in the middle by a wedge means 102 and is feed double-folded between two rollers 103, 103' and two feeding rollers 104, 104'.

The paper web can be folded many times in such a way that the folded web has the pages in a successive or sequential order with half of the pages on one side and the other half of the pages on the other side the folded web is transported to an on-line or integrated Rotary Stapling Machine 105, having the rollers 2, 3 and 4 arranged as illustrated in FIG. 1, whereby two staples can be attached to the folded paper web to the region intended to be the back of the printed publication.

Hereafter the folded and staple attached paper web 100 is passing two rollers 106, 106' and to a cutting means 107, having a roller 107' and a knife 107".

The thus cutted paper web 100' and the printed publication is now folded once again of a roller 108 along a line defined by the orientation of the staples and can so folded be transported to a further folding means 109 and the completed folded publication, such as newspaper 100" can be transported with the use of a conveyor 110.

It will be understood that the invention is not restricted to the described and illustrated exemplifying embodiments thereof and that modifications can be made within the scope of the inventive concept as defined in the following Claims.

I claim:

1. A rotary stapling machine comprising:

a first rotatable roller having a cylindrical surface;

retaining means mounted on said first rotatable roller which coact with said first roller to retain a U-shaped staple in a predetermined position of orientation with legs of the staple directed away from the retaining means;

a second rotatable roller having a cylindrical surface, adjacent to the first roller, the first and second rollers being spaced to allow material to be stapled to pass therebetween;

a die mounted on the second roller and positioned at the cylindrical surface of said second roller, the die including a slot which accommodates two plates which are directed toward one another, each plate pivotally mounted on a respective axle;

wherein the die and the retaining means are positioned relative to the cylindrical surfaces of the first and second rollers so to be brought to a mutually coacting position upon rotation of the first and second rollers, wherein said die and said retaining means coact to bend legs of the U-shaped staple in a direction towards said retaining means;

wherein said plates are pivotally movable toward the first rotatable roller to bend said legs and to hold the legs within a region included by the cylindrical surface of the first roller located adjacent said retaining means.

2. A machine according to claim 1, wherein each of said plates has an actuator surface which is rotatable within an angle less than 45°, from a leg-bending commencing position to a leg-bending terminating position.

3. A machine according to claim 2, wherein the legs of the staple are generally parallel with a leg-joining part of the staple when the actuator surfaces are in the bending terminating position.

4. A machine according to claim 3, wherein said leg-bending plates are positioned to commence bending of the legs before the leg-joining part reaches a position adjacent to the die unit.

5. A machine according to claim 1, wherein the legs of the staple are generally parallel with a leg-joining part of the staple when the bending plates are in a bending terminating position.

6. A machine according to claim 5, wherein said leg-bending plates are positioned to commence bending of the legs before the leg-joining part reaches a position adjacent to the die unit.

7. A machine according to claim 1, wherein said leg-bending plates are positioned to commence bending of the legs before a leg-joining part of the staple reaches a position adjacent to the die unit.

8. A machine according to claim 1, wherein the die further comprises a reciprocal punch actuated by a camming plate to rotate the leg-bending plates to a position in which the legs are fully bent.

9. A machine according to claim 8, wherein the punch is mounted in the die for reciprocating movement in a radial direction of the second roller.

10. A machine according to claim 1, the die further comprising a spring to move the leg-bending plates to a position in which bending of the legs is commenced.

* * * * *